United States Patent [19]

Mahaffy et al.

[11] 4,055,671

[45] * Oct. 25, 1977

[54] HERMETICALLY SEALED PACKAGE

[75] Inventors: Reid A. Mahaffy, Montclair; Joel A. Hamilton, Englewood; Wesley W. Pinney, Upper Montclair, all of N.J.

[73] Assignee: Mahaffy & Harder Engineering Company, Totowa, N.J.

[ * ] Notice: The portion of the term of this patent subsequent to Jan. 9, 1990, has been disclaimed.

[21] Appl. No.: 597,883

[22] Filed: July 21, 1975

Related U.S. Application Data

[63] Continuation of Ser. No. 295,134, Oct. 5, 1972, abandoned, which is a continuation-in-part of Ser. No. 64,035, July 22, 1970, Pat. No. 3,709,702, which is a continuation of Ser. No. 484,284, Sept. 1, 1965, abandoned.

[51] Int. Cl.[2] ..... B65D 5/64; B65D 85/72

[52] U.S. Cl. ..... 426/123; 206/484; 229/43; 426/106; 426/121; 426/129

[58] Field of Search ..... 426/121, 123, 124, 129, 426/106, 130, 396; 206/461, 484, 526; 229/2.5, 87 F, 43, 51 TS; 53/22 A

[56] References Cited

U.S. PATENT DOCUMENTS

| | | | |
|---|---|---|---|
| 2,621,129 | 12/1952 | Ramsbottom et al. | 426/127 |
| 3,054,679 | 9/1962 | Bradford | 426/23 |
| 3,079,057 | 2/1963 | Colarusso | 229/3.5 |
| 3,216,832 | 11/1965 | King | 53/22 A |
| 3,338,723 | 8/1967 | Lundquist | 426/121 |
| 3,343,332 | 9/1967 | Mahaffy et al. | 53/22 A |
| 3,344,912 | 10/1967 | Sternau | 229/43 X |
| 3,347,011 | 10/1967 | Lovas et al. | 53/22 |
| 3,498,018 | 3/1970 | Seiferth et al. | 53/22 |
| 3,695,900 | 10/1972 | Young et al. | 426/121 |
| 3,709,702 | 1/1973 | Mahaffy et al. | 426/123 |

*Primary Examiner*—Steven L. Weinstein

*Attorney, Agent, or Firm*—Parmelee, Johnson, Bollinger & Bramblett

[57] ABSTRACT

A sealed package comprising a cup-shaped container of relatively heavy-gauge, semi-rigid (form-retaining) plastic, with a protective member of relatively stiff material over the opening. Between the container and the protective member is a hermetic sealing closure member in the form of a relatively thin (flexible) plastic film secured around the rim of the cup. The package interior is evacuated and atmospheric pressure stretches the flexible film into the cup to engage the packaged article(s) across the full width thereof, i.e., up to the side walls of the cup. A relatively rigid and planar paper board sheet overlies the flexible film and is secured thereto by an adhesive stronger than the bond between the flexible film and the semi-rigid cup.

1 Claim, 7 Drawing Figures

20
21
12
10
26
2
33
Vacuum
36
32
30
22
14
1
24
50
38
18
Vacuum
48
Vent
46
44
42
Gas
52
40

HERMETICALLY SEALED PACKAGE

This application is a continuation of application Ser. No. 295,134, filed Oct. 5, 1972, now abandoned, which in turn is a continuation-in-part based on copending application Ser. No. 064,035, now U.S. Pat. No. 3,709,702, filed July 22, 1970, which in turn is a continuation of application Ser. No. 484,284, now abandoned, the priority date of which is Sept. 1, 1965, asserted herein for all common subject matter. This invention relates to the packaging of food products and the like in hermetically-sealed containers.

For a number of years now, extensive use has been made of automatic apparatus for packaging products in evacuated containers formed of flexible plastic packaging material. In some cases, the products were inserted in preformed pouches which were then evacuated and sealed along the opening. Subsequently (see, for example, U.S. Pat. No. 3,061,984), completely automatic machines were developed to form packages from two sheets of flexible plastic film drawn from respective supply rolls. In either case, the resulting container was formed entirely of thin flexible film. Thus the ultimate evacuation of the container caused the film to be forced inwardly by atmospheric pressure into close and intimate pressure-contact with the enclosed product, and distorting the film into a shape conforming to the product profile.

For many products, this flexible packaging approach provided reasonably acceptable results. However, such packaging techniques did entail some problems, and it was not really satisfactory for certain types of products, for example, a shingled group of bacon slices. Thus, there has existed a need for improved packaging approaches, to avoid deficiencies of the prior art.

Accordingly, it is a principal object of this invention to provide an evacuated package which is superior to those available heretofore. Another object of this invention is to provide novel techniques for packaging certain specialty products, especially bacon. Other objects, aspects and advantages of this invention will in part be pointed out in, and in part apparent from, the following description considered together with the accompany drawings, in which.

Figure 1:
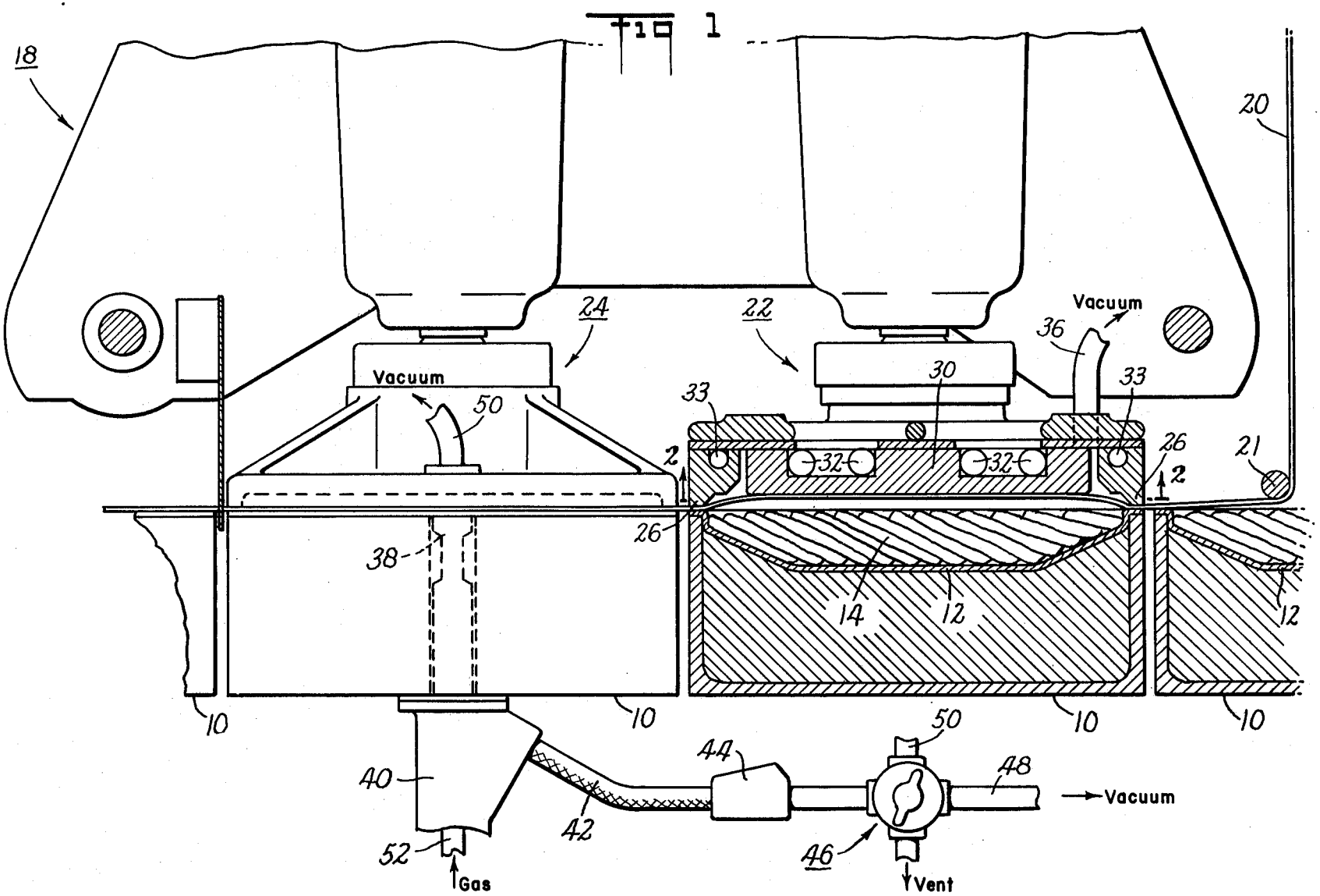
FIG. 1 is a longitudinal vertical section through a part of a packaging machine.

Referring now to FIG. 1, the packaging apparatus comprises a series of trays 10 each adapted to receive and snugly support a corresponding cup-like receptacle or container member 12 carrying a product 14, in this case a one-pound shingled group of bacon slices. These trays are power-driven from right to left with an intermittent cyclical indexing movement to permit certain sequential packaging operations to be performed at respective stations along the path of movement.

Receptacles 12 are made of transparent, calendered non-plasticized polyvinyl chloride, advantageously having a thickness in the range of five to fifteen mils. Such polyvinyl chloride is "semi-rigid", meaning that it is self-supporting and substantially retains its shape under normal conditions of use, e.g. with a normal product load such as might be simulated by filling the receptacle with water.

The receptacles are formed with flat peripheral flanges 16 extending entirely around the opening, and lying in a common plane. The receptacles are in the shape of a truncated triangular prism, best illustrated in FIG. 3, and having a cross-section presenting sloping side walls in the form of an isosceles trapezoid as shown in FIG. 4.

Figure 3:
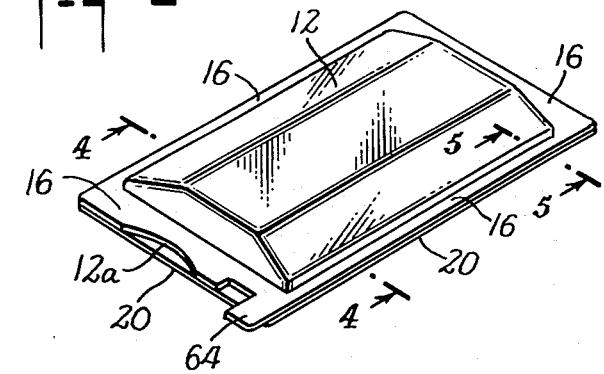
FIG. 3 is a perspective view of a completed package.
Figure 4:
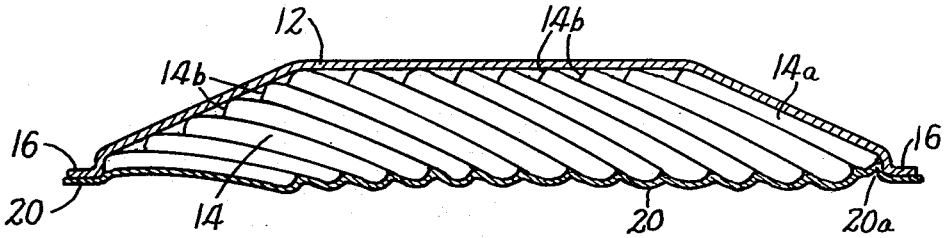
FIG. 4 is a cross-section taken along line 4—4 of FIG. 3.

More specifically, the container member 12 comprises a flat generally rectangular central face (forming the top surface of the package, in the normal upright position shown in FIG. 3). Two flat generally rectangular side walls slope away from opposite sides of said central face towards the opening of the container. The central face is parallel to the plane of the container opening. Each of the side walls slopes outwardly from the central face at a relatively large included angle, e.g. greater than about 135° with respect to the central face, as shown in the drawings. The side walls are adapted to receive in flat condition an end slice of the shingled bacon, readily visible to a prospective customer through the transparent plastic sheet, for inspection of the quality of the bacon. The side walls are joined to the flanges 16 by short wall elements which are substantially perpendicular to the flanges.

The container 12 further comprises two end walls contiguous with the central face and the sloping side walls referred to above. These end walls are substantially perpendicular to the central face of the container, although the end walls preferably may slope at a slightly obtuse angle with respect to the container opening, e.g. to facilitate loading of the product.

Above two adjacent positions of the trays 10 is a packaging head generally indicated at 18 and mounted (by conventional means, not shown) for vertical reciprocating movement in synchronism with the indexing of the trays. That is, when the trays stop, head 18 moves down to carry out certain operations to be described, and then rises just before the next indexing movement, so as to permit the trays to be shifted horizontally without interference.

To the right of packaging head 18, a web of flexible plastic packaging film 20 descends vertically to a lay down roll 21. This roll aids in applying the film to the top of the trays 10 as they are shifted into the first position under the packaging head 18. The film is drawn from a supply roll (not shown) and has a width sufficient to cover the receptacles 12 including the side flanges thereof. In the disclosed embodiment, film 20 is a laminate of saran-coated polyester and polyvinyl chloride, and the polyvinyl chloride side faces down to engage the polyvinyl chloride receptacles 12. Thus the heat-sealing properties of the film 20 are compatible with those of the receptacles and both provide a good oxygen barrier.

Figure 2:
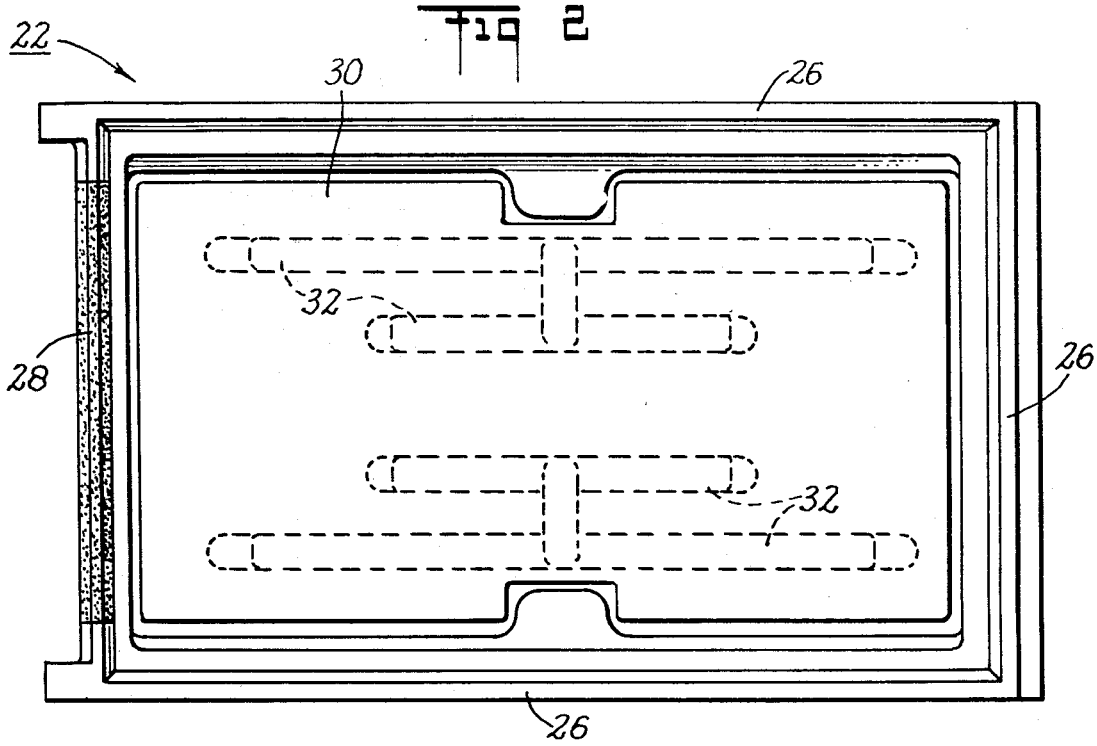
FIG. 2 is a detail horizontal section (from below), showing the preliminary sealing means of the packaging machine.

The packaging head 18 includes both a preliminary seal means, generally indicated at 22, and an evacuation and final seal means, generally indicated at 24. The preliminary seal means further comprises peripheral heat-sealing bars 26 (see FIG. 2) arranged to extend around three flanges of the receptacle 12 and partially along the fourth flange. The gap in the heat-sealing bar along the fourth flange is filled with a low thermal conductivity, heat-resistant elastomer 28, e.g. silicone rubber, the lower edge of which is in the same plane as the heat sealing bars, or projects slightly below. Thus, when the head 18 descends, it presses the film 20 tightly against all of the flanges 16, sealing the film against air leakage around the entire periphery of the preliminary sealing means.

Also carried by the packaging head 18, within the preliminary seal means 22, is a flat platen 30 the lower surface of which is about ⅛ inch above the plane of the heat-sealing bars 26. The side edges of this platen are spaced a small distance from the interior side walls of the heat-sealing bars. This platen is formed to receive a set of heater elements 32, additional to the sealing heaters 33, to maintain the platen at a moderately elevated temperature.

When the packaging head 18 is in its lower position, the chamber defined by the preliminary sealing means 22 is evacuated by a vacuum line 36. As shown in FIG. 1, this causes the film 20 to be forced uniformly up against the platen 30 so that the film becomes somewhat softened by the heat. Such softening makes it readily possible, by application of reasonable pressure, to stretch the film, e.g. beyond its elastic limit, for purposes as will be described subsequently.

While the receptacle 12 is in the preliminary seal position, the heated bars 26 operate in known manner to heat-seal the film 20 to the corresponding receptacle 12 along three of the flanges 16. Since the elastomer 28 is not heated, that end of the receptacle is not sealed to the film.

The head 18 thereafter rises and the partially sealed receptacle 12 is indexed to the next position where the evacuation and final sealing of the package take place. To this end, each tray 10 is provided with a captive "web-lifter" 38 which, in accordance with prior art techniques, is shifted up (through a previously formed cup-out 12*a* in the receptacle 12) to raise the end of the film 20 opposite the unsealed flange of the receptacle. The package then is evacuated through the channel thus created between the film and the receptacle. The vacuum is drawn through the web-lifter passage in the tray, through a vertically reciprocable gasketed coupler 40, a line 42 including a check valve 44 and the main vacuum valve 46 to which is connected a vacuum conduit 48. This main valve 46 also connects vacuum through a line 50 to the chamber above the film 20.

After evacuation, main valve 46 is shut off and an inert gas is admitted into the package from a gas line 52. The gas passes through an internal conduit in the web-lifter support, and exits into the package through an aperture in the top of the web-lifter. When the proper amount of gas has been admitted, the web-lifter is allowed to drop back down to its normal rest position and the usual heated "final seal bar" descends from above the film 20 to complete the heat-sealing of the film to the receptacle 12. This final seal extends along the side of the receptacle interiorly of the aperture 12*a*, and overlaps the preliminary seal lines so as to make the package completely gas-proof.

Thereafter, main valve 46 is shifted to its vent position, admitting atmospheric air through line 50 into the final seal chamber above the film 20. The check valve 44 momentarily restrains the flow of air into the trays 10, but the air pressure above and below the package equalizes fairly quickly because some air will flow downward into the web-lifter passage which is imperfectly closed off by the final seal bar in its lowered position. In some cases, it may be desirable to speed up this pressure equalization by providing an adjustable-restriction by-pass valve around the check valve 44.

The inrush of atmospheric pressure above the film 20 serves to force this film down into the receptacle 12, causing the film to be stretched. The extent of stretching depends upon how much gas had previously been admitted into the package. Preferably, the admission of gas is adjusted to that amount which results in the edges of the bacon being pressed lightly against the interior surface of the receptacle 12 when the package is in its normal upright position as shown in FIG. 3.

The stretching of the film 20 interiorly of the flanges 16 is aided by the heat applied in the preceding preliminary seal operation. Thus the film is somewhat softened so that it can be stretched, advantageously to an amount resulting in a permanent set of the plastic material. In any event, the film is force-fitted and stretched by the atmospheric pressure around all of the contours of the exposed pieces of bacon. The receptacle 12, being made of semi-rigid material, is not so formed about the bacon but instead contacts the edges of the bacon with the desired pressure engagement sufficient to assure that the bacon is immobilized within the package. This arrangement particularly is advantageous because shifting of the bacon can smear grease on the interior of the receptacle and interfere with a prospective customer's inspection of the product.

The pressure of the product against the interior of the receptacle 12 should be sufficient to press any large flat product surfaces, such as that of the end slice 14*a*, into full contact with the interior of the receptacle. However, the pressure desirably is low enough to avoid squashing the bacon edges 14b flat against that interior. This degree of pressure provides a superior package appearance while preventing shifting of the product, disarray and grease smearing.

Figure 5:
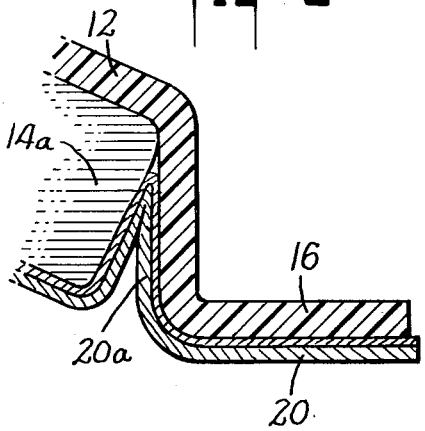
FIG. 5 is a detail view, greatly magnified, of one corner of FIG. 4.

In the final seal stage, physical stretching of the interior marginal portions of the film 20 inwardly to the product 14, especially to a permanent set dimension, is desirable because it tends to eliminate any substantial build-up of tension in the film. As shown in FIG. 5, the film is formed inwardly at 20*a* to follow the side wall contour of the receptacle 12. Thus the force of the atmospheric pressure is carried essentially by the packaged product, aided by the internal gas pressure. This avoids placing portions of the package under heavy stress, and minimizes distortion of the semi-rigid receptacle from its original shape.

Figure 6:
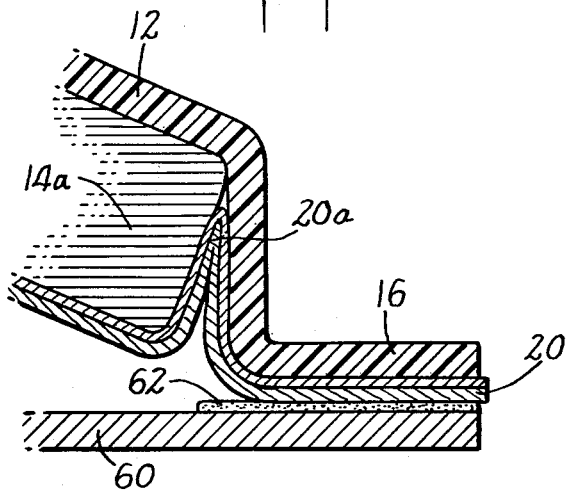
FIG. 6 is a detail view, like FIG. 5, showing a complete 3-element package construction in accordance with this invention.
Figure 7:
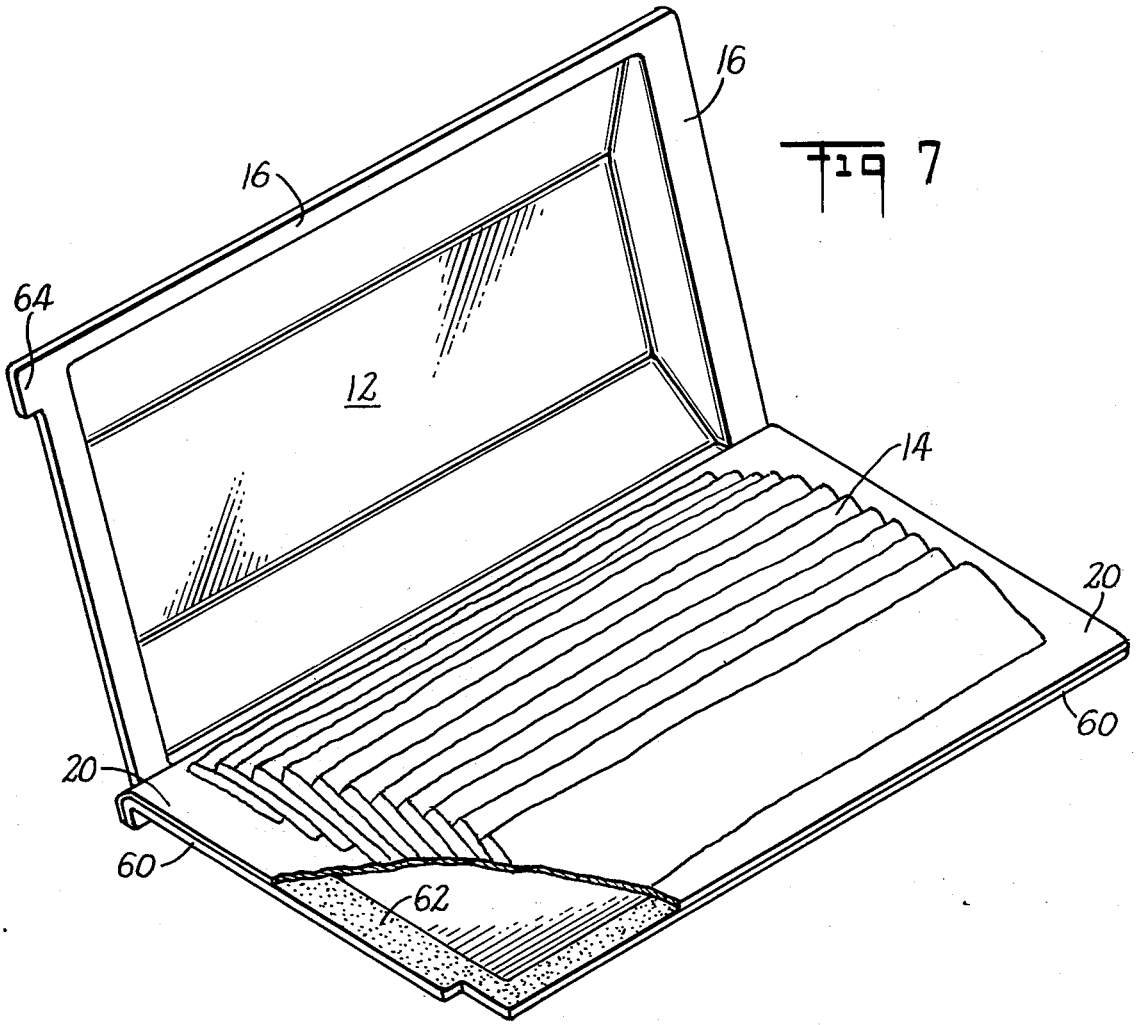
FIG. 7 is a perspective view showing the package of FIG. 6 with its top folded back.

As shown in FIG. 3, the semi-rigid container member 12 serves as the display top in the normal upright position of the package, and, referring also to FIGS. 6 and 7, a paper-board protective member 60 advantageously is secured in place over the container opening. The flexible film 20 is between the board 60 and the container 12. The board 60 is thicker than film 20, preferably between 5 and 12 mils. This paper board provides important protection, by minimizing the chance that the package might be punctured, e.g. in shipment or handling. The board also provides additional rigidity.

The protective board member 60 is secured to the film 20 around all of the marginal edges, as by means of a sealant 62, activated by conventional heating means. The protective member 60 advantageously is provided with means permitting it to be at least partially disengaged from the container member, e.g. as shown in FIG. 7, and further readily permitting the two to be readily reengaged after a portion of the product has been removed.

The sealant 62 may preferably form a bond substantially stronger than that between film 20 and semi-rigid member 12, so that it becomes more readily possible to open the package simply by peeling the package, the film and paper board, as a unit, away from the semi-rigid member 12. After a portion of the product has been removed, paper board member 60 can act as a base, providing physical support and protection for the remaining product after reclosure, and is adapted to function in the nature of a platter, holding the product for serving, upon re-opening of the reclosed package.

One side of the semi-rigid member 12 is formed with a finger tab 64 to aid in opening the package. As shown in FIG. 7, along the left-hand edge of the plastic film 20, and the protective board 60, extend out beyond the container member 12, to permit grasping of such extended portion to aid in opening the package. When the package is opened, the board 60 will bend about a longitudinal line running along the back of the package, the board being somewhat pliable relative to the semi-rigid member 12. This laterally extending side edge of the board 60 provides one example of means, previously referred to, for permitting the board and container member to be at least partially disengaged, and this arrangement, wherein the disengagement is effected through cooperative manipulation of the laterally extending side edge of the board and tab 64, with the board bending about the longitudinal back line without completely disconnecting, provides for ready reengagement of the board and container after a portion of the product has been removed.

When the package is first opened, the relief of the vacuum permits the film 20 and the product to fall down to the level of the paper board 60. When the package is reclosed for storage of remaining bacon, it is possible to place the package in a stack of similar packages, or to place other articles on top, without injuring the remaining product.

We claim:

1. A hermetically sealed and evacuated package assembly comprising a cup-shaped container holding a perishable food product and having side walls with a continuous planar peripheral flange around its opening, said container member being made of semi-rigid gas-impermeable plastic material adapted to provide mechanical protection for the contained food product, the upper surfaces of said product being below the flange of the container member at least in the region adjacent the container side walls when said semi-rigid container is positioned with said opening facing upwards:

a stiff planar protective member secured to said container member in position parallel to and covering said opening a short distance from the adjacent surfaces of said product, said protective member defining a gas-permeable bottom element for the package when the semi-rigid container serves as the protective top element in the normal upright position of the completed package assembly, said bottom element acting as a base providing physical support and protection for the remaining food product after the package assembly has been opened for removal of a portion of the food product and then has been reclosed; and a sheet of flexible stretchable gas-impermeable material disposed over said opening, between said container member and said protective member, to serve as a closure member for the package, said sheet being sealed to the flange of said container member around the periphery of said opening to cooperate with said container member in hermetically sealing said package from outside atmosphere, said sheet material being substantially thinner than said semi-rigid material and incapable of providing substantial mechanical protection for the contained product, said sheet material being sufficiently flexible that it is of nonform-retaining characteristic, said flexible material immediately adjacent said flanges comprising preformed portions shaped by stretching prior to package evacuation to extend into said container along the side walls thereof, said preformed portions being held by atmospheric pressure in tight and intimate form-fitting engagement with said product and said side walls, the portions of said flexible material which are held against said product being spaced from said protective member, the stretching of said flexible material being carried to a permanent-set dimension sufficient to avoid distortion of said semi-rigid container due to the force of atmospheric pressure on said flexible material;

said flexible sheet having a part thereof which extends out beyond the peripheral edge of said container member flange to provide for manipulation of said extending part to permit said closure member to be at least partially disengaged from said container member to gain access to the enclosed food product; and means providing for reclosure of said protective member and said container member with said protective member means secured to said container member to hold a remaining part of the product.

* * * * *